United States Patent [19]

Bettcher

[11] 3,985,057

[45] Oct. 12, 1976

[54] COMESTIBLE SLICING APPARATUS

[75] Inventor: Louis A. Bettcher, Amherst, Ohio

[73] Assignee: Bettcher Industries, Inc., Birmingham, Ohio

[22] Filed: Feb. 24, 1975

[21] Appl. No.: 552,173

Related U.S. Application Data

[63] Continuation-in-part of Ser. No. 498,394, Aug. 19, 1974, abandoned.

[52] U.S. Cl. ..... 83/703; 83/717; 83/733; 83/409.2; 83/411 R; 83/419

[51] Int. Cl.[2] ..... B26D 4/34; B26D 7/03

[58] Field of Search ..... 83/703, 409.2, 411 A, 83/417, 419, 733, 174.1, 440.2, 544, 88, 411 R, 713, 717

[56] References Cited

UNITED STATES PATENTS

| | | | |
|---|---|---|---|
| 2,616,173 | 11/1952 | Perkins | 83/411 R X |
| 3,252,367 | 5/1966 | Nann | 83/411 R X |
| 3,782,230 | 1/1974 | Bettcher | 83/703 X |
| 3,867,858 | 2/1975 | Tsuchiya et al. | 83/411 A X |

FOREIGN PATENTS OR APPLICATIONS

| | | | |
|---|---|---|---|
| 857,782 | 4/1940 | France | 83/88 |

*Primary Examiner*—Willie G. Abercrombie
*Attorney, Agent, or Firm*—Watts, Hoffmann, Fisher & Heinke Co.

[57] ABSTRACT

Slicing apparatus having a magazine with upright inwardly inclined product receptacles on a rotatable member for carrying comestible workbodies in a circular path past a rotating knife in a table recess to sever slices from the bottom of workbodies, table height adjustment for controlling the thickness of slices being severed, a unitary plastic or like guard for the knife, knife sharpening apparatus carried by the guard, and a guard surrounding the rotatable workbody carrier.

5 Claims, 2 Drawing Figures

COMESTIBLE SLICING APPARATUS

CROSS REFERENCES TO RELATED APPLICATIONS

This application is a continuation-in-part of co-pending application, Ser. No. 498,394 filed Aug. 19, 1974, now abandoned, the disclosure of which is incorporated herein by reference.

BACKGROUND OF THE INVENTION

1. Field of the Invention

This invention relates to comestible product slicing apparatus having a movable carrier and in which a product to be cut and the carrier are moved relative past one another in a predetermined path to effect the cutting operation.

2. Prior Art

Slicing apparatus of the general character to which the present invention relates is known, as illustrated by U.S. Pat. No. 3,782,230. This type of apparatus is widely used to slice frozen elongated meat products often preformed in a press and the magazines or receptacles for holding the products to be sliced are vertical or substantially vertical with the result that the product is sliced normal or essentially normal to its length.

SUMMARY OF THE INVENTION

This invention provides a novel and improved apparatus for slicing elongated comestible products or workbodies such that the area of the slice produced as viewed in plan is greater than the cross-sectional area of the product being sliced in a plane normal to its length at the location where the slice is cut therefrom.

The invention further provides a novel and improved slicing apparatus of the character referred to comprising a movable cutter and a receptacle for an elongated comestible product or workbody movable relative to one another for cutting slices from the workbody in which the receptacle and the product being sliced is inclined at an appreciable angle preferably from about 30° to 70° to the path of relative movement therebetween and the cutter during a cutting operation.

The invention further provides a novel and improved slicing apparatus of the character referred to comprising a movable magazine having one or more receptacles for carrying comestible workbodies past a relatively thin metal disk-like knife rotatable about a stationary generally vertical axis to cut slices from the lower ends of the workbodies and having means for controlling the thickness of slices being cut, wherein the receptacles are inclined to the plane of the knife at an appreciable angle as mentioned above with their lower ends trailing as they pass by the knife in the process of cutting slices from the lower ends of the workbodies therein.

Further objects and advantages of the invention will be referred to and/or be apparent from the following description of the preferred embodiment described with reference to the accompanying drawings.

DESCRIPTION OF PREFERRED EMBODIMENT

Figure 1:
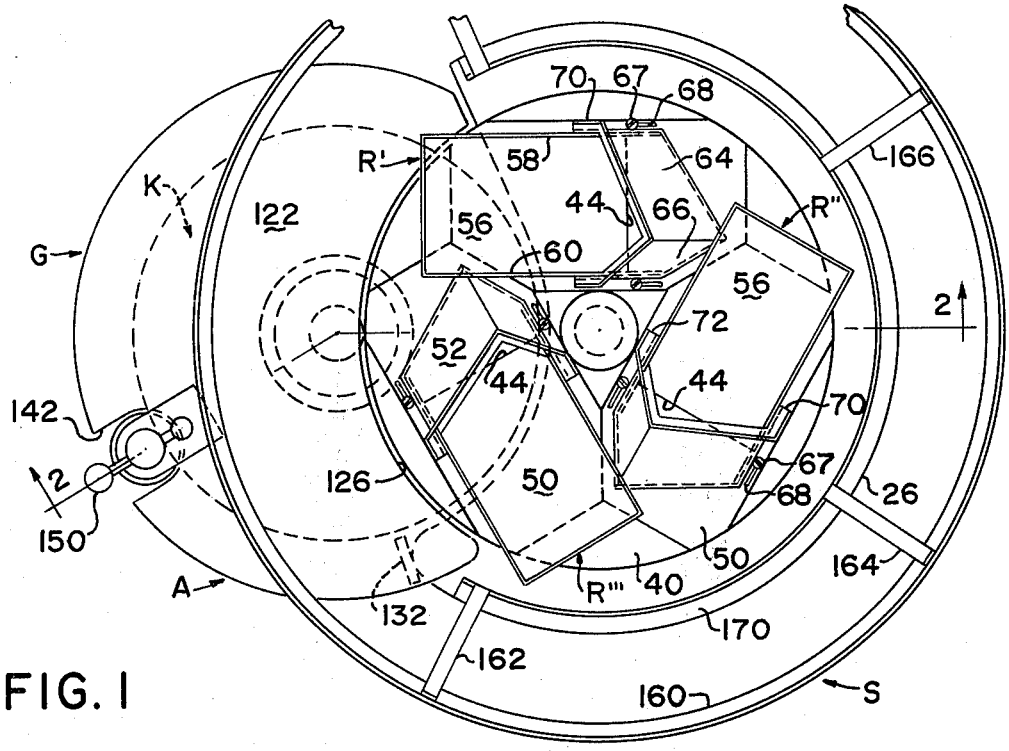
FIG. 1 is a plan view of slicing apparatus embodying the present invention.
Figure 2:
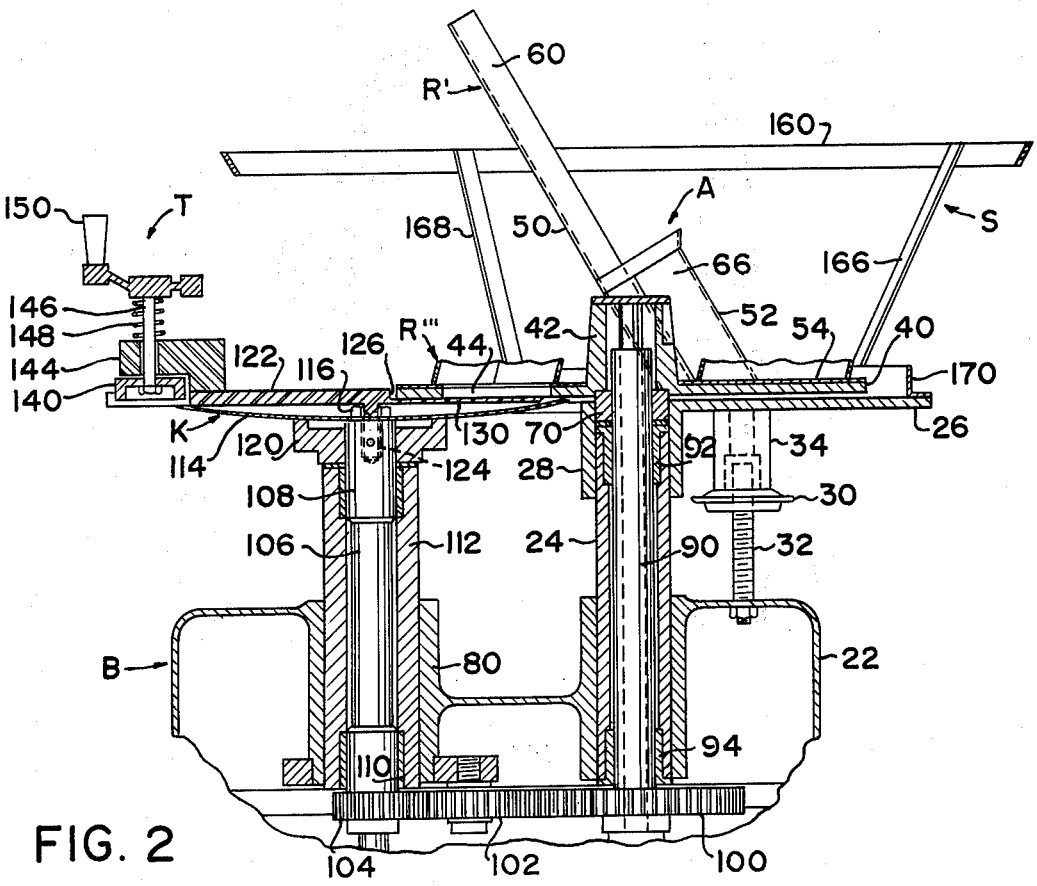
FIG. 2 is a fragmentary sectional view with parts in elevation approximately on the line 2—2 of FIG. 1.

The slicing apparatus shown in the drawings, and designated generally by the reference character A comprises a stationary base B similar to that shown in U.S. Pat. No. 3,782,230, having fixedly secured to its upper part 22 a vertically extending tubular member 24 upon the upper end of which a workbody supporting table 26, having a downwardly extending tubular boss 28, is supported for vertical adjustment by means of a hand wheel 30 threaded onto an upwardly projecting threaded member 32 fixed to the top of the part 22 of the base B and against the upper part of which hand wheel the lower end of a tubular member 34 fixed to the underside of the table 26 abuts.

The bodies or articles to be sliced are carried in a product magazine assembly M comprising a circular member 40 having a central supporting hub 42 and one or more openings 44, in the present instance three 44', 44'', 44''', through which workbodies can pass downward through the plate, rest upon the table 26, and be carried across a rotary knife K upon rotation of the magazine.

In the preferred embodiment the products or workbodies to be sliced are supported in and guided in their downward movement to the knife K by receptacles R, of which there are three R', R'', R''', located on the member 40, one above each of the openings 44. The receptacles R are constructed to slidably support a workbody in an inclined position with their lower ends trailing with respect to the direction of rotation of the magazine assembly, which as viewed in FIG. 1 is counter-clockwise. This construction utilizes the inertia of the workbodies to exert downward force upon the workbody when the receptacle is rotated.

Each receptacle R is formed of two sheet metal members 50, 52 fixed to a base plate 54. The member 50 is shaped to form a generally channel-like member having a flat bottom wall 56 and side walls 58, 60 normal to the bottom wall and is fixed to the base plate 54 at an angle of about 60° with its open side trailing with respect to the direction of rotation of the magazine assembly. The member 52 is also shaped to form a generally two-sided troughlike member having flat walls 64, 66 at an angle of about 100° to 110° to one another. The bottom walls 64, 66 of the member 52 terminates in side walls 70,72 parallel with one another and approximately equal in height to the side walls 58,60 of the member 50. The channel member 50 is longer than the channel member 52, in the preferred embodiment about three times as long. The channel member 52 is secured to the base plate 54 and to the channel member 50 with the side walls 70,72 outwardly of but closely engaged with the walls 58,60 of the member 50.

The construction of the receptacles is such that each includes a lower tubular part having a flat wall 56 inclined with respect to the direction of rotation of the magazine assembly M and having opposed walls 64,66 at an angle to one another and inclined with respect to the direction of rotation of the magazine assembly M at the same angle so that the ridge formed where the side walls 64,66 join is parallel to the flat wall 56. The part of the channel member 50 extending about the channel member 52 provides a chute-like structure for guiding workbodies into the lower tubular shaped part of the receptacle. The base plates 54 of the respective receptacles have apertures therein such that the lower ends of the tubular parts of the receptacles are entirely open.

The base members 54 are adjustably connected to the member 40 by screws 67 extending through slots 68 in the members 54 and threaded into suitably topped holes in the member 40 in positions such that the lower ends of the tubular parts of the receptacles communicate with the openings 44 in the member 40 so that workbodies in the receptacles can drop onto the table 26. The adjustment of the receptacles R provided by the screws 67 permits one to adjust the effective sizes of the openings 44.

Each of the receptacles R are inclined down and back relative to the direction of rotation of the magazine assembly M and the inclination thereof is preferably approximately 60°. The degree of inclination will depend to some extent upon the character of the workbody being sliced and other inclinations may be employed. Preferred inclinations are from about 30° to 70°. When a workbody in one of the receptacles is moved past the knife upon rotation of the product magazine it will be apparent that the slice cut from the lower end thereof will have a larger area in plan than the cross-sectional area of the workbody normal to its length and if the slices are to have a predetermined weight it will be apparent that slices such as produced by the present apparatus will be larger in plan that similar slices produced with the vertical or essentially vertical receptacle, that is, receptacles vertical or essentially vertical to the plane of the knife K.

The member 40 of the product carrier assembly M is keyed to a short tubular member 70 pinned to a tubular shaft 90 adjacent to its upper end. The shaft 90 is rotatably supported in suitable upper and lower bearings 92,94 in the member 24. A thrust bearing 96 is located between the lower end of the member 70 and the upper end of the bearing 92, a flange of which rests upon the upper end of the member 24. The shaft 90 and in turn the product carrier M is rotated by a gear 100 fixedly secured to the lower end of the shaft 90. The construction is such that the magazine M can be lifted and removed from the rest of the apparatus for cleaning, etc.

The gear 100 is in mesh with an idler gear 102 supported in the base part 22 and which idler gear is in turn in mesh with a gear 104 fixed to the reduced lower end of a shaft 106 rotatably supported by suitable upper and lower bearing members 108,110 in a tubular member 112 fixed in the upper part 22 of the base B and projecting upwardly therefrom. The shaft 106 may be driven in any suitable manner such as the manner in which the shaft 106 is driven in the aforesaid U.S. Pat. No. 3,782,230.

In the preferred embodiment illustrated the knife K comprises a relatively thin disk-like resilient metal member 114 and is fixed by a headed screw 116 to the upper side of an annular flanged member 120 fixed to the shaft 106 adjacent to its upper end. The member 120 is supported on the upper end of the member 112 by a suitable bearing or thrust member located between the lower side thereof and the upper end of the member 112. The headed screw 116 is threaded into the aperture in the upper end of the shaft 106 a sufficient amount to stress and flex the member 114 into a desired saucer or concave-convex shape. It will be apparent from the amount or degree of concavity the knife K can be adjusted by turning the screw 116 which preferably has an interference or locking fit with the shaft 106 so that it will retain its adjusted position during operation of the apparatus. The flexing of the knife member 114 increases its rigidity or stability and permits the use of a much thinner member than would otherwise be possible.

The knife K carries a unitary guard G resting upon its upper peripheral surface. The guard G comprises a crescent-shaped portion or part 122 which if desired may have a downwardly extending arcuate flange along its convex edge the inner wall of which would extend around and protect that portion of the periphery or cutting edge of the knife which is not underneath the member 40. At its center the crescent-shaped part 122 of the guard is provided with a downwardly projecting cylindrical boss 124 extending into a suitable cylindrical aperture in the center of the screw 116. There is a small clearance between the head of the screw 116 and the underside of the guard so that the guard rests upon the knife. The concave side of the crescent-shaped guard G forms an arcuate concave wall 126 spaced from but conforming essentially to the circumference of the plate 40. The guard G shown has a very thin part 130 formed integral with the part 122 and extending above that part of the knife beneath the magazine M and almost to the edge of the knife K so that the product from which a slice is being cut will slide smoothly over the knife to the guard and back over the knife to the table 26. The part 130 of the guard G may be omitted, if desired. The desirability of its use depends in part upon the amount or degree that the knife was bowed or dished. The less the knife was dished the less necessary and/or desirable would be the use of the part 130 of the guard.

The guard is preferably made of a suitable non-toxic or edible plastic, for example, an acrylonitrile-butadiene-styrene copolymer or Nylon. The use of such a plastic is particularly advantageous as they are nonporous, will not absorb bacteria, are highly resistant to acids and alkalines, have a clean appearance, becomes white with age, have adequate weight to ridge properly on the knife, do not warp or bend, have low coefficients of friction, are easily cleaned, and are poor conductors of heat which is advantageous in apparatus used to slice frozen products.

Both the magazine assembly M and the knife K are rotated counter-clockwise as viewed in FIG. 1. The guard G has a tendency to rotate with the knife but such rotation is limited or prevented by the engagement of a stop 132 against the periphery of the vertically adjustable table or member 26. The stop 132 shown is in the form of a rectangular boss formed as an integral part of the guard G and projecting downwardly from the underside of the leading end of the crescent-shaped part of the guard, referring to the direction of rotation of the knife K. The stop 132 extends down from the underside of the guard a distance great enough to accommodate the full vertical adjustment of the table 26. The stop 132 is so positioned that during the operation of the apparatus the arcuate surface 126 of the guard G is maintained close to the periphery of the rotating member 40 of the magazine assembly M without riding thereon.

In the preferred embodiment, the guard G is provided with or carries a knife sharpening assembly, designated generally as T, and having a grinding wheel 140 located in an aperture 142 in the periphery of the guard G in position to be selectively engaged with the top sides of the peripheral cutting edge of the knife K. The grinding wheel is supported in a member 144 detachably connected to the guard. Grinding wheel 140 is of the straight cup-type or shape and is detachably fixed to the lower end of a shaft 146 rotatably supported by suitable bearings in the member 144 so that the working face of the grinding wheel is in a plane normal to the axis of rotation of the knife. The shaft 146 is normally urged in an upwardly direction away from the knife K by a compression spring 148 interposed between the member 144 and a hand crank 150 detachably fixed to the upper end of the shaft 146.

The upper side of the knife K is provided with a narrow annular planar surface about its perimeter and when it is desired to sharpen the cutting edge of the knife K the handle 150 is manually pushed so as to engage the working face of the wheel 140 with the cutting edge of the knife K and the wheel rotated to engage different parts of the working surface of the wheel with the cutting edge of the knife. The knife sharpening tools or wheels 140 is preferably of the abrasive grit-type but may be made of other material, for example, steel.

The guard G is supported on the knife K without being fixedly secured thereto so that it can be readily removed with or without the removal of other parts of the machine for the purpose of cleaning, etc. The knife sharpening assembly, which, as shown, is detachably connected to the guard and can be removed from the guard for cleaning and other servicing. The guard may be furnished without the knife sharpening assembly in which event the cutout portion of the aperture in which the grinding wheel is located could be omitted.

To reduce the danger of an operator being struck by a product receptacle R during rotation of the magazine M a stationary guard S is provided. The guard S comprises an annular metal band 160 connected to the upper ends of a plurality of members 162, 164, 166, 168, the lower end of which is integral with an arcuate metal band 170 supported on the top of the table 26. The metal member 170 can be removably connected to the table 26 in any suitable manner. The members 162, 164, 166, 168 diverge outwardly from the member 170 with the result that the annular member 160 is located radially of the table and the product magazine assembly M. While the guard member 160 is shown surrounding the workbody carrier or magazine assembly M it will be apparent that the part thereof which overlies the knife guard G may be omitted, if desired.

From the foregoing description of the preferred embodiment of the invention it will be apparent that the objects heretofore enumerated and others have been accomplished and that there has been provided a novel and improved slicing apparatus for comestible workbodies.

While the preferred embodiment of the invention has been described in considerable detail, the invention is not limited to the construction shown and/or described and it is the intention to hereby cover all adaptations, modifications and use of the invention which come within the practice of those skilled in the art to which it pertains and the scope of the appended claims.

I claim:

1. In an apparatus for severing parts from a comestible workbody, such as, meat, a frame assembly, a table-like member supported by said frame assembly and having an upwardly facing planar surface, movable cutter means supported by said frame assembly with its cutting edge offset outwardly of said planar surface, a workbody carrier supported by said frame assembly and having a workbody receptacle located outwardly of said planar surface and said cutter means with an open end thereof adjacent to said table-like member, power means for producing relative movement between said carrier and said cutter means in a predetermined path generally parallel to said planar surface of said table-like member. to cut a slice from a workbody in said receptacle, said receptacle at least the lower part of which is tubular being inclined at an angle of about 30° to 70° with respect to the upwardly facing planar surface of said table-like member and with the end thereof adjacent to the planar-like surface trailing, and means for varying said outward relative position of said cutter means and said table-like member to vary the thickness of slices cut from the workbodies.

2. In an apparatus for severing parts from a comestible workbody, such as, meat, a frame assembly, a table-like member supported by said frame assembly and having an upwardly facing planar surface and an aperture therein, rotary knife means in said aperture and supported by said frame assembly for rotation about an axis normal to said planar surface with its cutting edge offset outwardly of said planar surface, a workbody carrier supported by said frame assembly outwardly of said planar surface and said knife means and having a workbody receptacle with an open end adjacent to said table-like member, power means for producing relative movement between said receptacle and said knife means in a predetermined path generally parallel with said planar surfaces of said table-like member to cut a slice from a workbody in said receptacle, said receptacle at least the lower part of which is tubular being inclined at an angle of about 30° to 70° with respect to the upwardly facing planar surface of said table-like member and with the end thereof adjacent to the planar like surface trailing, and means for varying said outward relative position of said knife means and said table-like member to vary the thickness of the slices cut from the workbodies.

3. In an apparatus for severing parts from a comestible workbody, such as, meat, a frame assembly, a table-like member supported by said frame assembly and having an upwardly facing planar surface and an aperture therein, rotary knife means in said aperture and supported by said frame assembly for rotation about an axis normal to said planar surface with its cutting edge offset outwardly of said planar surface, a workbody carrier supported by said frame assembly outwardly of said planar surface and said knife means for rotation about an axis parallel with and offset from the axis of rotation of said knife means and having a plurality of workbody receptacles with open ends adjacent to said table-like member open, power means for rotating said workbody carrier in a predetermined path to cut a slice from workbodies in said receptacles, said receptacles at least the lower parts of which are tubular being inclined at angles of about 30° to 70° with respect to the upwardly facing surface of said table-like member and with their ends adjacent to said table-like member trailing, and means for varying said outward relative position of said knife means and said table-like member to vary the thickness of the slices cut from workbodies.

4. In an apparatus for severing parts from a comestible workbody, such as, meat, a frame assembly, a table-like member supported by said frame assembly and having an upwardly facing planar surface and an aperture therein, rotary knife means in said aperture and supported by said frame assembly for rotation about an axis normal to said planar surface with its cutting edge offset outwardly of said planar surface, a workbody carrier supported by said frame assembly outwardly of said planar surface and said knife means for rotation about an axis parallel with and offset from the axis of rotation of said knife means and having a plurality of workbody receptacles with open sides adjacent to said table-like member open, power means for rotating said workbody carrier in a predetermined path to cut a slice from workbodies in said receptacles, said receptacles at least the lower parts of which are tubular being inclined at angles of about 30° to 70° with respect to the upwardly facing surface of said table-like member and with their ends adjacent to said table-like member trailing, means for varying said outward relative position of said knife means and said table-like member to vary the thickness of the slices cut from workbodies, and guard means carried by said table-like member and surrounding at least part of said workbody carrier.

5. In an apparatus for severing parts from a comestible workbody, such as, meat, a frame assembly, a table-like member supported by said frame assembly and having an upwardly facing planar surface and an aperture therein, rotary knife means in said aperture and supported by said frame assembly for rotation about an axis normal to said planar surface with its cutting edge offset outwardly of said planar surface, a workbody carrier supported by said frame assembly outwardly of said planar surface and said knife means for rotation about an axis parallel with and offset from the axis of rotation of said knife means and having a workbody receptacle with an open side adjacent to said table-like member, power means for rotating said workbody carrier in a predetermined path to cut a slice from a workbody in said receptacle, said receptacle at least the lower part of which is tubular being inclined at an angle of about 30° to 70° with respect to the upwardly facing surface of said table-like member and with the end thereof adjacent to said table-like member trailing and at least a part of the leading side of said receptacle being not less than twice the length of the trailing side, means for varying said outward relative position of said knife means and said table-like member to vary the thickness of a slice cut from a workbody in said receptacle, and guard means carried by said table-like member and surrounding at least part of said workbody carrier.

* * * * *